US007810678B2

(12) United States Patent
Alluigi

(10) Patent No.: US 7,810,678 B2
(45) Date of Patent: Oct. 12, 2010

(54) DISPENSING DEVICE AND PUMPING ELEMENT

(75) Inventor: Riccardo Alluigi, Acqui Therme (IT)

(73) Assignee: Guala Dispensing S.p.A., Spinetta Marengo, Alessandria (IT)

( * ) Notice: Subject to any disclaimer, the term of this patent is extended or adjusted under 35 U.S.C. 154(b) by 443 days.

(21) Appl. No.: 11/667,500

(22) PCT Filed: Sep. 23, 2005

(86) PCT No.: PCT/IT2005/000545

§ 371 (c)(1),
(2), (4) Date: Jun. 28, 2007

(87) PCT Pub. No.: WO2006/082605

PCT Pub. Date: Aug. 10, 2006

(65) Prior Publication Data

US 2007/0278252 A1 Dec. 6, 2007

(30) Foreign Application Priority Data

Feb. 4, 2005 (IT) ..... BS2005A0013

(51) Int. Cl.
*B65D 37/00* (2006.01)

(52) U.S. Cl. ..... 222/207; 222/383.1; 92/36; 92/93; 92/104

(58) Field of Classification Search ..... 222/207, 222/209, 383.1, 481.5, 574; 92/34–47, 93, 92/104

See application file for complete search history.

(56) References Cited

U.S. PATENT DOCUMENTS

| | | | | |
|---|---|---|---|---|
| 3,726,442 | A * | 4/1973 | Davidson et al. | 222/207 |
| 4,867,347 | A * | 9/1989 | Wass et al. | 222/153.13 |
| 4,936,492 | A * | 6/1990 | Amiel et al. | 222/207 |
| 4,962,851 | A * | 10/1990 | Schuckmann et al. | 222/209 |
| 5,551,636 | A * | 9/1996 | Foster et al. | 239/333 |
| 2004/0026458 | A1 | 2/2004 | Fuchs | |

FOREIGN PATENT DOCUMENTS

EP 0 274 877 A1 7/1988

OTHER PUBLICATIONS

International Search Report for PCT/IT2005/000545 dated Jan. 26, 2006.

* cited by examiner

*Primary Examiner*—Kevin P Shaver
*Assistant Examiner*—Andrew Bainbridge
(74) *Attorney, Agent, or Firm*—Kilyk & Bowersox, P.L.L.C.

(57) ABSTRACT

A device for dispensing at least one fluid comprises pumping means comprising an elastic deformable membrane (2) having a wavy annular wall (16) for producing a desired stiffness or pliability for said membrane (2). A pumping element (1) comprises a base (4) and said elastic deformable membrane (2).

25 Claims, 10 Drawing Sheets

DISPENSING DEVICE AND PUMPING ELEMENT

This application is a National Stage Application of PCT/IT2005/000545, filed Sep. 23, 2005, which claims priority from Italian Patent Application No. BS2005A000013, filed Feb. 4, 2005.

The object of the present invention is a fluid dispensing device. In particular, the object of the present invention is a fluid dispensing device of the type comprising a deformable membrane for the dispensing of said fluid.

Some dispensing devices known in the art comprise a deformable membrane. Some embodiments of such devices are shown, for example, in documents U.S. Pat. Nos. 3,726,442, 3,986,644 and 5,551,636.

However, the embodiments shown in such documents exhibit several disadvantages.

Among the others, it has been found that following a repeated use of the device, for example after a repeated actuation of the trigger or of the dispensing button, said trigger or said button tend to return to the initial position very slowly, thus giving the user the unpleasant feeling that the device is jammed.

Such disadvantage mainly arises from the tendency of the membranes used, after repeated consecutive uses, to remain collapsed, thus preventing both the intake of new fluid for dispensing and the return of the trigger or of the button to the initial position.

Further embodiments are described, for example, in documents U.S. Pat. Nos. 4,978,037 and 4,962,851. Such documents show fluid dispensing devices provided with a deformable membrane having reinforcing ribs on the surface.

However, also these embodiments exhibit some disadvantages. In fact, such membranes exhibit an uneven structure with stronger zones at the ribs and weaker zones at the portions without ribs.

As known, the deformation of such membranes generates an uneven internal tensional state characterised by strong gradients, especially in the passage portions from the strong zones to the weak ones. Such gradients cause breakage, especially when the material forming the membrane exhibits notches, cracks and the like, arising from repeated and consecutive uses of the device.

The object of the present invention is to provide a device for dispensing a fluid which should overcome the disadvantages mentioned with reference to the prior art and which, in particular, should allow regular operation and high reliability also following repeated and consecutive uses of the device.

Such object is achieved by a device according to the following claim 1. The dependent claims describe embodiment variations.

The features and advantages of the device according to the present invention will appear more clearly from the following description, made by way of an indicative and non-limiting example with reference to the annexed figures, wherein.

Figure 2:
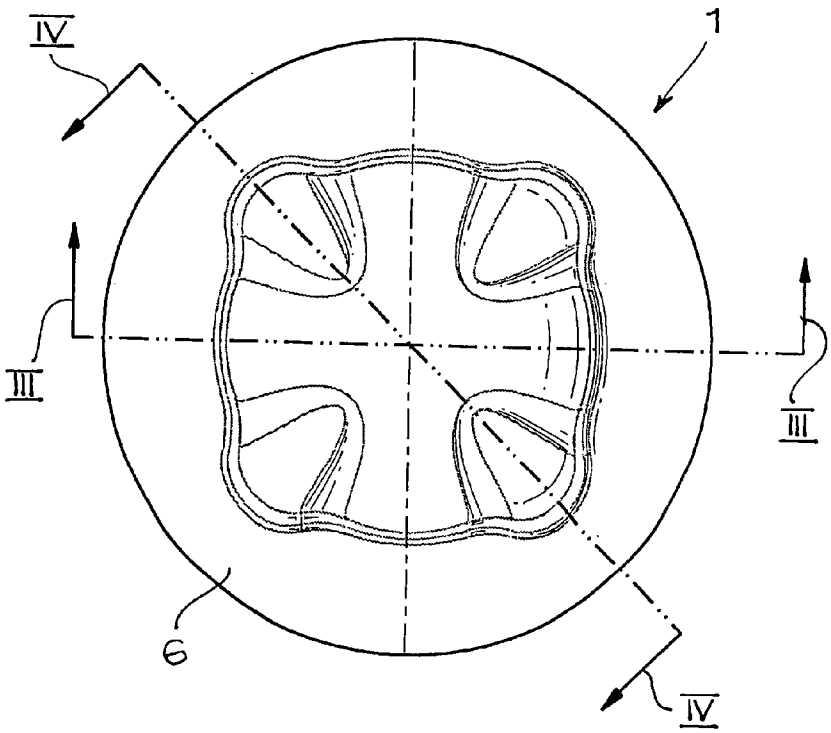
FIG. 2 shows a plan view of the pumping element of FIG. 1.

With reference to the annexed figures, reference numeral 100 globally denotes a fluid dispensing device.

The device 100 is associable to containment means suitable for containing said fluid.

According to a preferred embodiment, said containment means comprise a container (not shown), suitable for containing a single fluid or, according to an embodiment variation, suitable for containing two or more fluids separately.

The container exhibits an opening for the connection to said device 100.

Preferably, the device 100 comprises connecting means suitable for connecting said device to said containment means, preferably in a releasable manner.

According to a preferred embodiment, said connecting means comprise a threaded ring nut 110 or, according to a further embodiment, a ring nut provided with a bayonet connection for the connection to the container opening.

Moreover, the device 100 comprises pumping means suitable for sucking said fluid or said fluids from said containment means and suitable for dispensing said fluid from said device.

Said pumping means comprise at least one pumping element 1.

Moreover, said device comprises delimiting means suitable for cooperating with said pumping element 1 for defining a pumping chamber 120 wherein the fluid is sucked and wherefrom the fluid is ejected for dispensing.

Moreover, preferably, said delimiting means cooperating with said pumping element 1, produce an intake duct 130, suitable for placing said containment means in fluid communication with said pumping chamber, and an ejection duct 140, suitable for placing said pumping chamber is fluid communication with the outside of the device.

According to a preferred embodiment, said delimiting means comprise an abutment 150 connectable to said pumping element.

Moreover, said device 100 comprises actuating means suitable for being handled by an operator for actuating said pumping means and dispensing said fluid or said fluids.

According to a preferred embodiment, said actuating means comprise a trigger 170, of the movable or turnable type.

Trigger 170 comprises a handling portion 172 suitable for being suitable for being handled by the operator and a cooperation portion 174 suitable for cooperating with said pumping means.

According to a preferred embodiment, said cooperation portion is by single actuation, that is, suitable for cooperating with a single pumping element.

According to a further preferred embodiment, said cooperation portion is by multiple actuation, that is, suitable for cooperating with two or more pumping elements for dispensing two or more fluids. In particular, according to said embodiment, said cooperation portion comprises two or more tines for the cooperation with said pumping means.

According to a further embodiment, said actuating means comprise a button suitable for being pressed to dispense the fluid or fluids.

Figure 1:
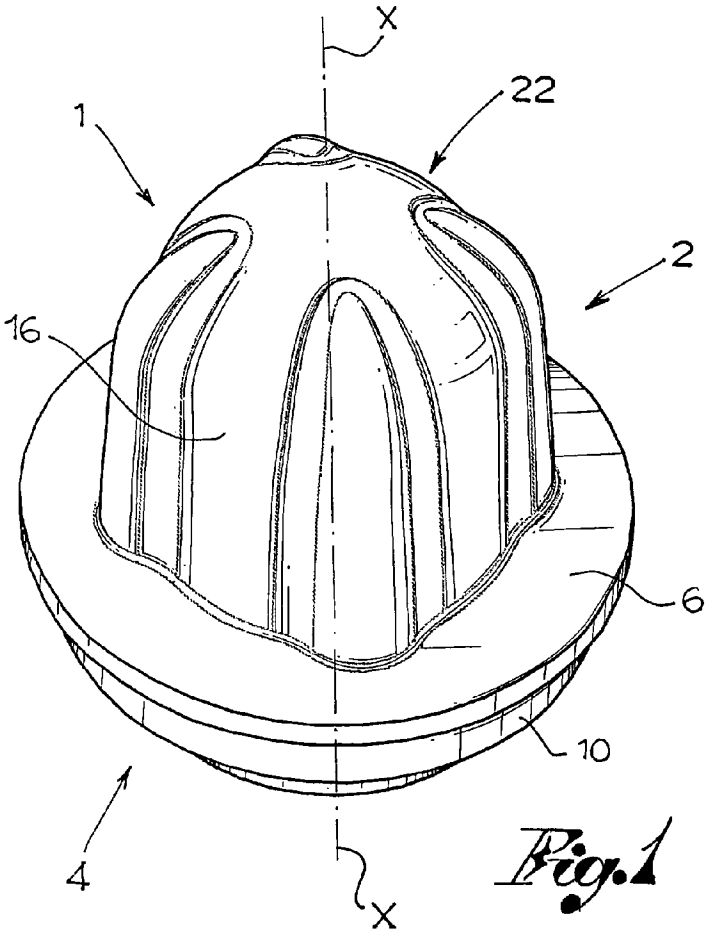
FIG. 1 shows a three-dimensional view of a pumping element of a fluid dispensing device, produced according to a first embodiment.
Figure 4:
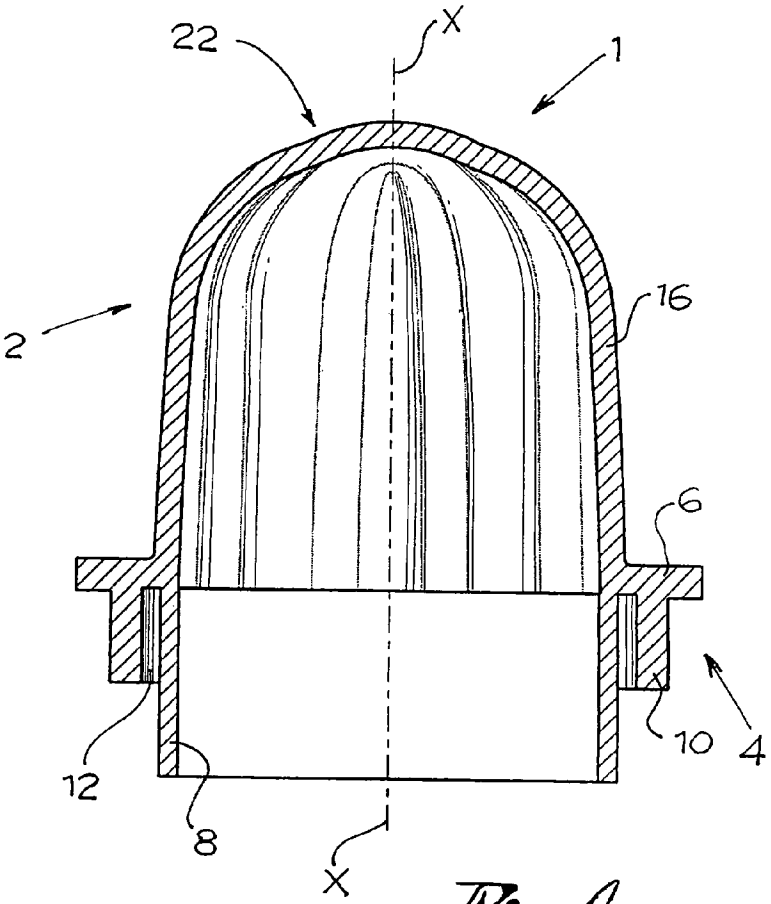
FIG. 4 shows a view of the pumping element of FIG. 1, sectioned according to line IV-IV of FIG. 2.
Figure 3:
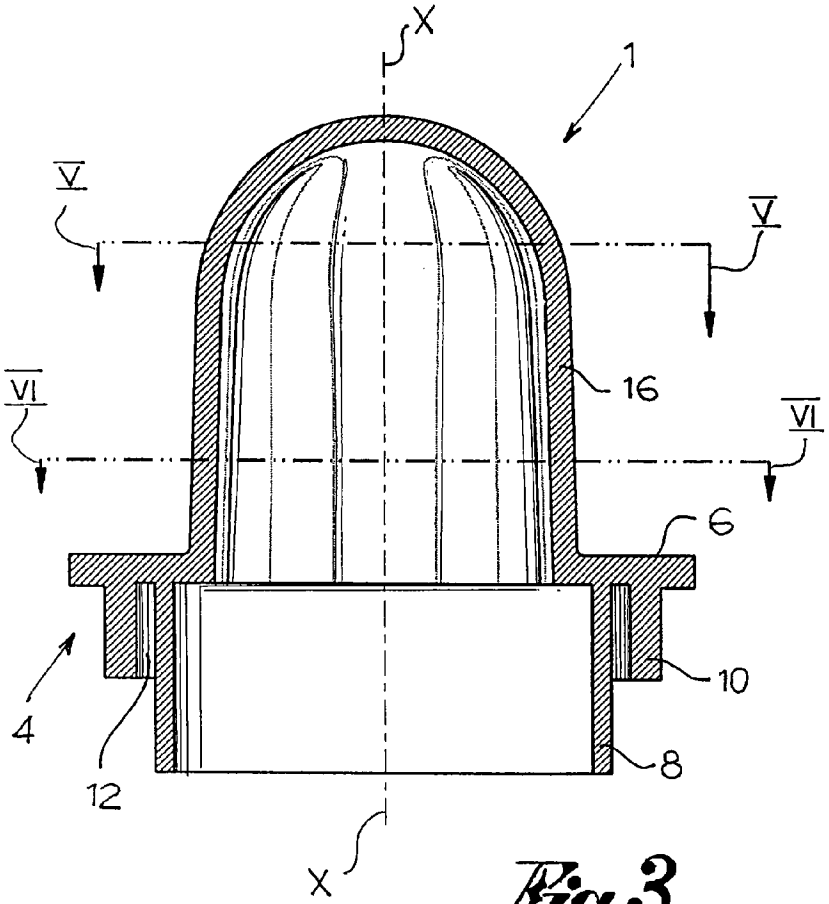
FIG. 3 shows a view of the pumping element of FIG. 1, sectioned according to line III-III of FIG. 2.
Figure 6:
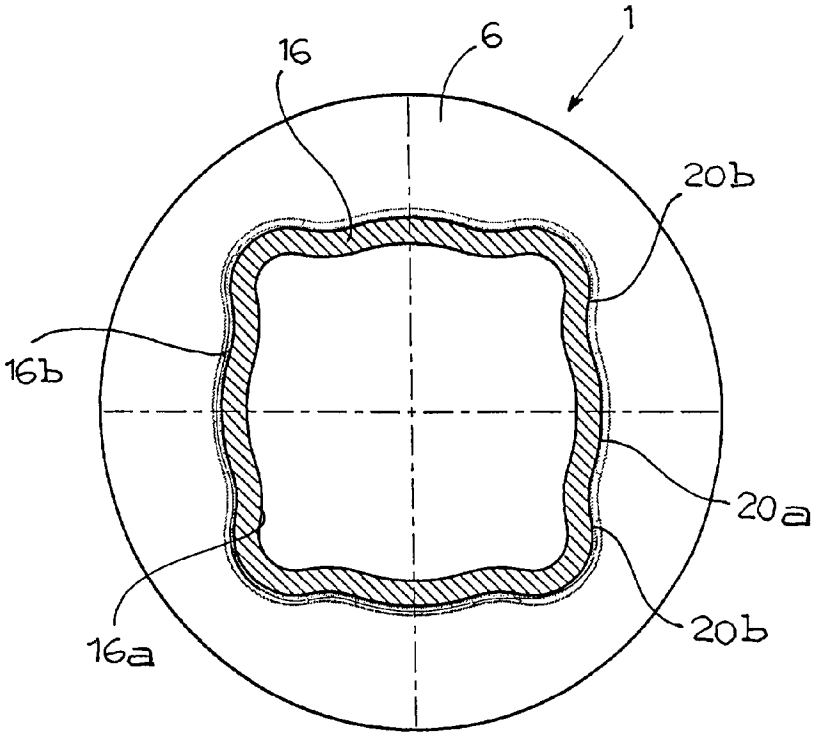
FIG. 6 shows a plan view of the pumping element of FIG. 1, sectioned according to line VI-VI of FIG. 3.
Figure 5:
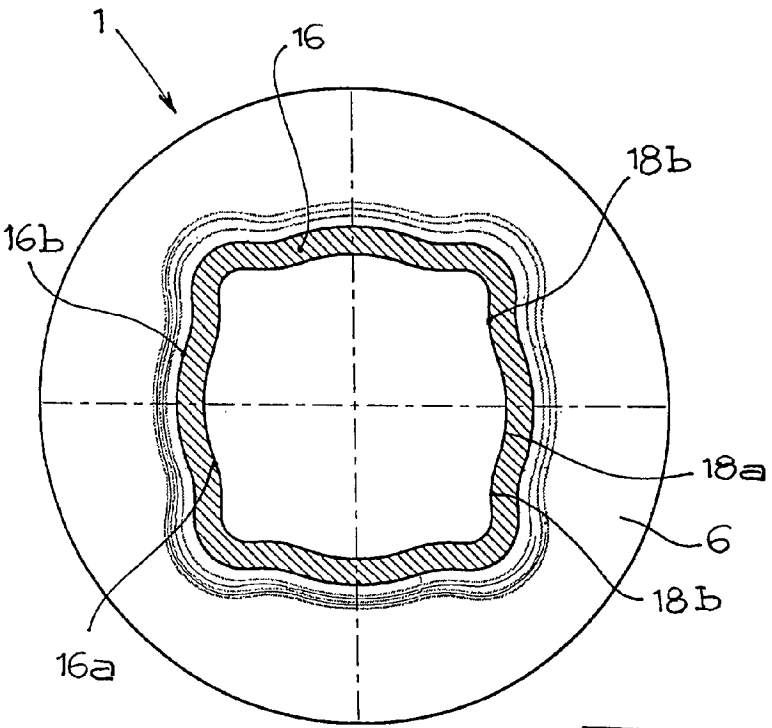
FIG. 5 shows a plan view of the pumping element of FIG. 1, sectioned according to line V-V of FIG. 3.
Figure 7:
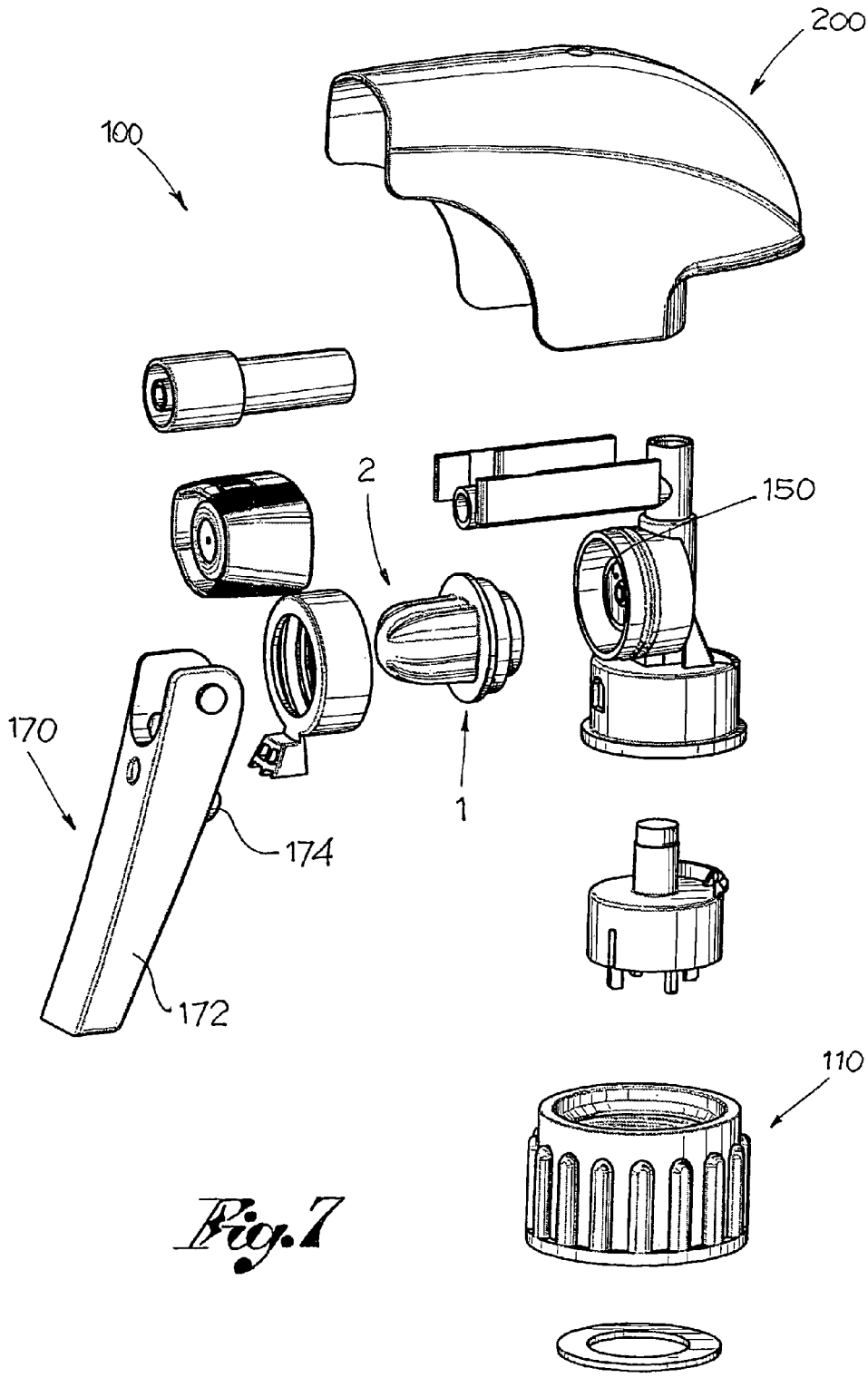
FIG. 7 shows an exploded view of a fluid dispensing device, in accordance with a first embodiment variation, comprising the pumping element of FIG. 1.
Figure 8:
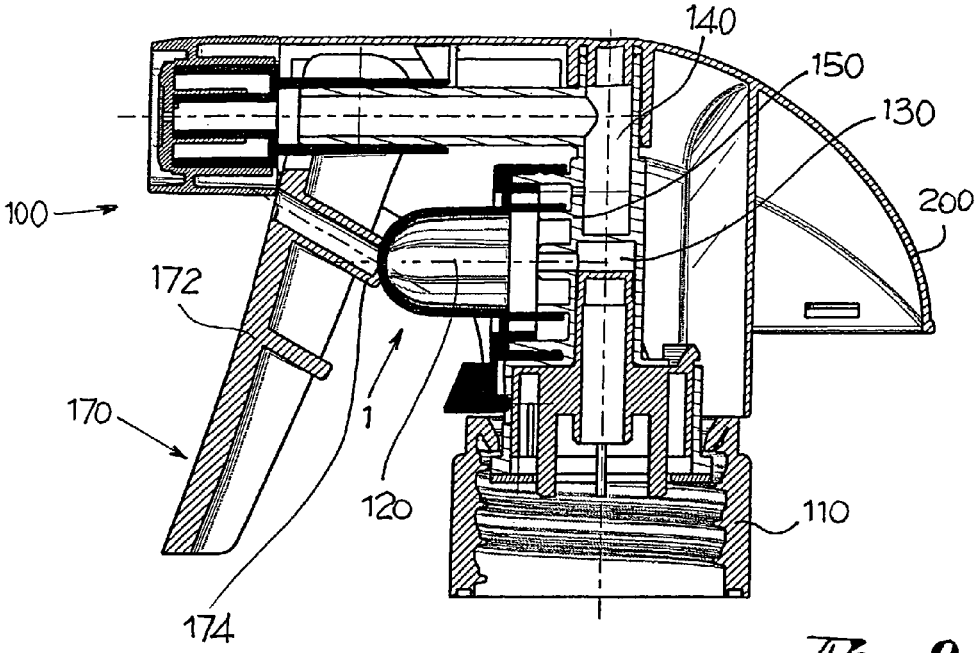
FIG. 8 shows a side section view of the device of FIG. 7 with assembled parts.
Figure 18:
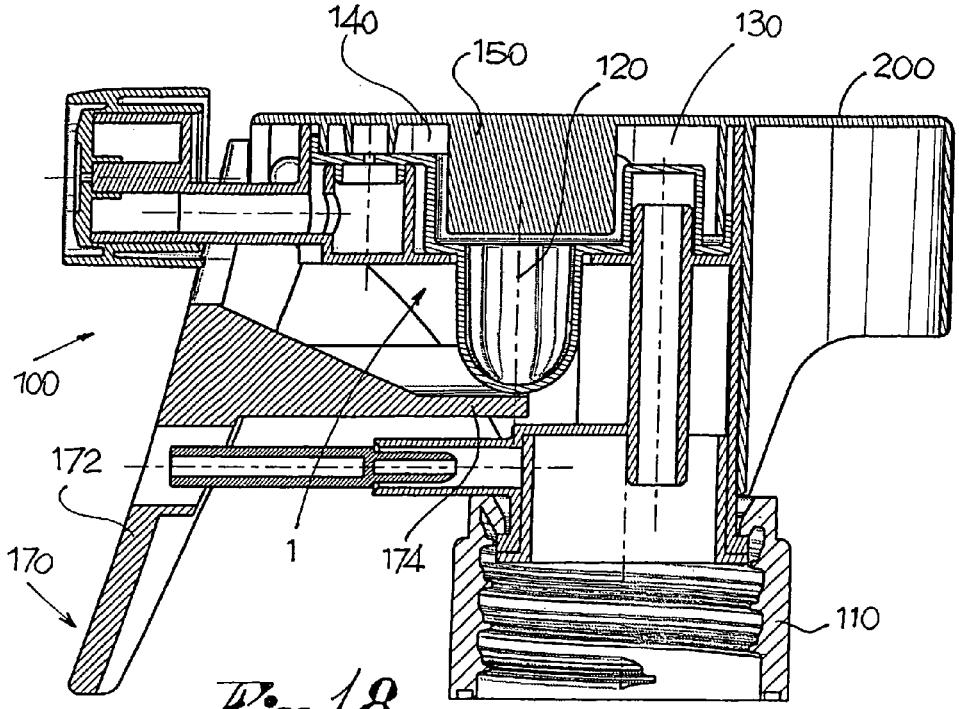
FIG. 18 shows a side section view of the device of FIG. 17 with assembled parts.
Figure 10:
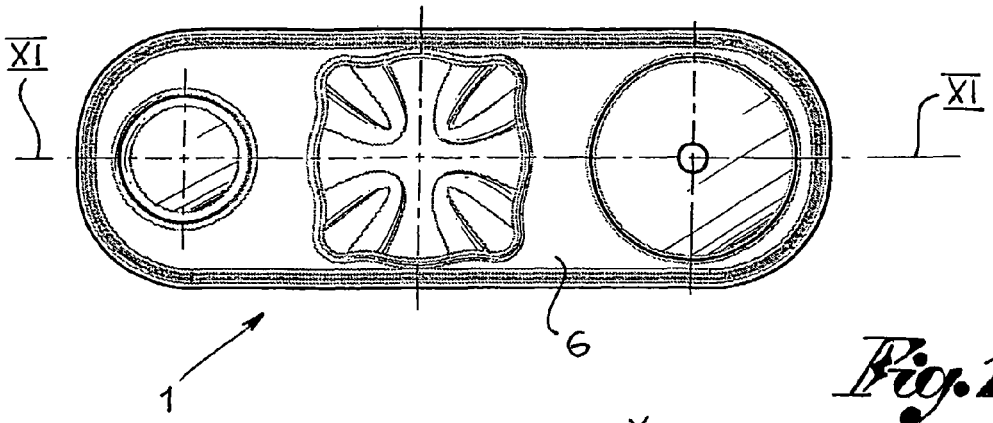
FIG. 10 shows a plan view of the pumping element of FIG. 9.

According to a first embodiment, the pumping element 1 is of the type with circular support (FIGS. 1 and 7).

The pumping element 1 comprises positioning means suitable for positioning said pumping element inside device 100 so that, cooperating with said delimiting means, said pumping chamber 120 and said intake 130 and ejection 140 paths are obtained.

The pumping element 1 comprises an elastic membrane 2 at least partly deformable which develops about a membrane axis X-X.

According to a preferred embodiment, said positioning means comprise a base 4 comprising a support 6 from which an internal annular wall 8 and an external annular wall 10 protrude.

Said annular walls 8, 10 are concentric and circumferentially arranged relative to said membrane axis X-X.

Moreover, said annular walls 8, 10 are radially spaced, thus forming an interspace 12 thereinbetween.

Membrane 2 comprises at least one active portion designed to be influenced by the actuating means of said device 100.

In particular, said membrane is deformable from a non-deformed configuration, wherein the pumping chamber 120 exhibits maximum volume, to a deformed configuration wherein the pumping chamber 120 exhibits a reduced volume, during a fluid ejection step.

During said ejection step, the fluid is ejected from the pumping chamber 120, flows through said ejection duct 140 and is dispensed outside the device.

Once said actuating means have been released, membrane 2, subject to the elastic return action thanks to the material it consists of, passes from the deformed configuration to the non-deformed configuration, during an intake step.

During said intake step, the fluid is sucked in by the containment means, flows through said intake duct 130 and is stored into the pumping chamber 120.

The active portion of membrane 2 comprises an annular wall 16 that develops with wavy pattern circumferentially about said membrane axis X-X.

In other words, once a section of the annular wall 16 has been made with a plane perpendicular to the membrane axis X-X, said annular wall is delimited by an internal edge 16*a* and by an external edge 16*b*.

Said edges exhibit wavy annular pattern.

In yet other words, said edges produce a closed line about said membrane axis X-X consisting of a succession of arched portions.

In particular, according to a preferred embodiment, the internal edge and the external-edge exhibit identical arched pattern, that is, they are homologous relative to the membrane axis X-X.

Preferably, said edges exhibit a polygonal shape, preferably squared or rectangular, wherein the sides are formed by a succession of curvilinear portions.

In particular, the internal edge 16*a* exhibits, relative to said membrane axis X-X, a concave portion 18*a*, jointed, on a side and on the other, to convex portions 18*b*. Such succession of jointed concave and convex portions produce said wavy pattern.

Similarly, the external edge 16*b* exhibits a central convex portion 20*a*, jointed, on a side and on the other, to side concave portions 20*b*. Such succession of jointed concave and convex portions produce said wavy pattern.

In yet other words, said annular wall 16 exhibits a succession of concave and/or convex portions.

In particular, said annular wall 16 exhibits a plurality of sides, wherein each side comprises at least one concave portion, and said concave portion is jointed to convex portions. Moreover, wherein said sides are jointed to one another by arched portions.

According to a preferred embodiment, the thickness of said annular wall 16 is substantially constant along the circumferential development of said wall about the membrane axis X-X.

Moreover, said membrane 2 exhibits a dome portion 22 which closes said membrane at the top.

Preferably, said dome portion 22 is externally smooth.

According to a further embodiment variation, said positioning means comprise said base 4 comprising intake valve means suitable for allowing the intake of the fluid during said intake step and for preventing the backflow of the fluid towards said containment means during said ejection step.

Figure 11:
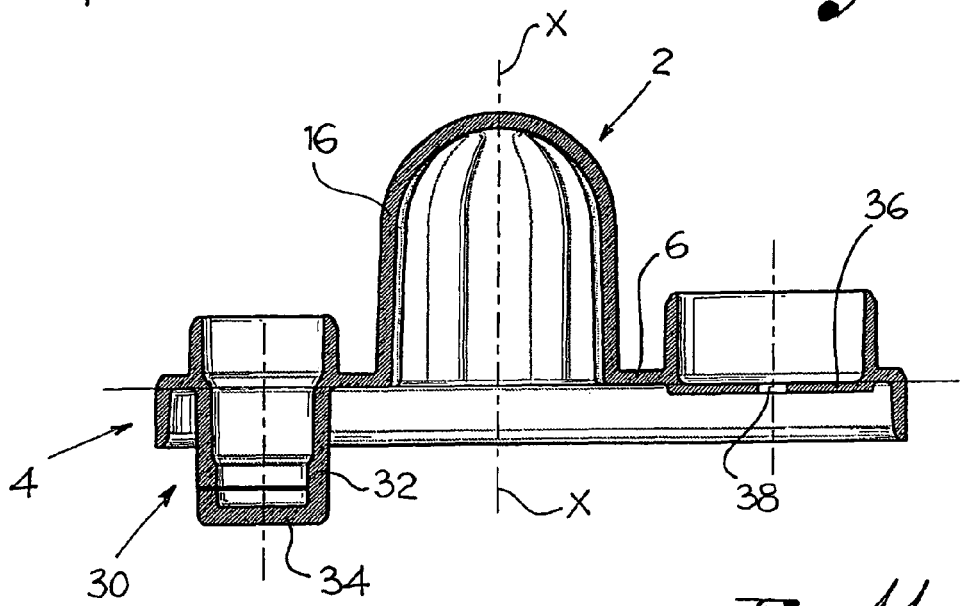
FIG. 11 shows a view of the pumping element of FIG. 9, sectioned according to line XI-XI of FIG. 10.
Figure 9:
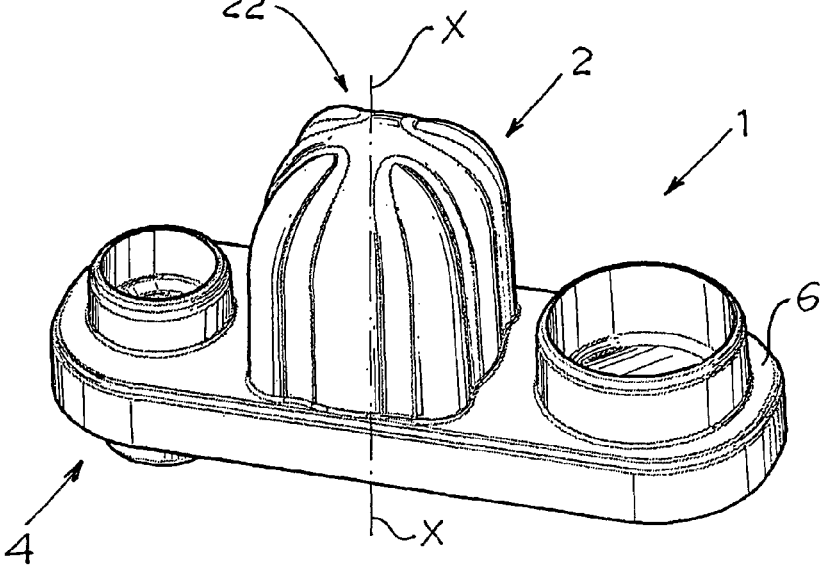
FIG. 9 shows a three-dimensional view of the pumping device according to a further embodiment variation.
Figure 12:
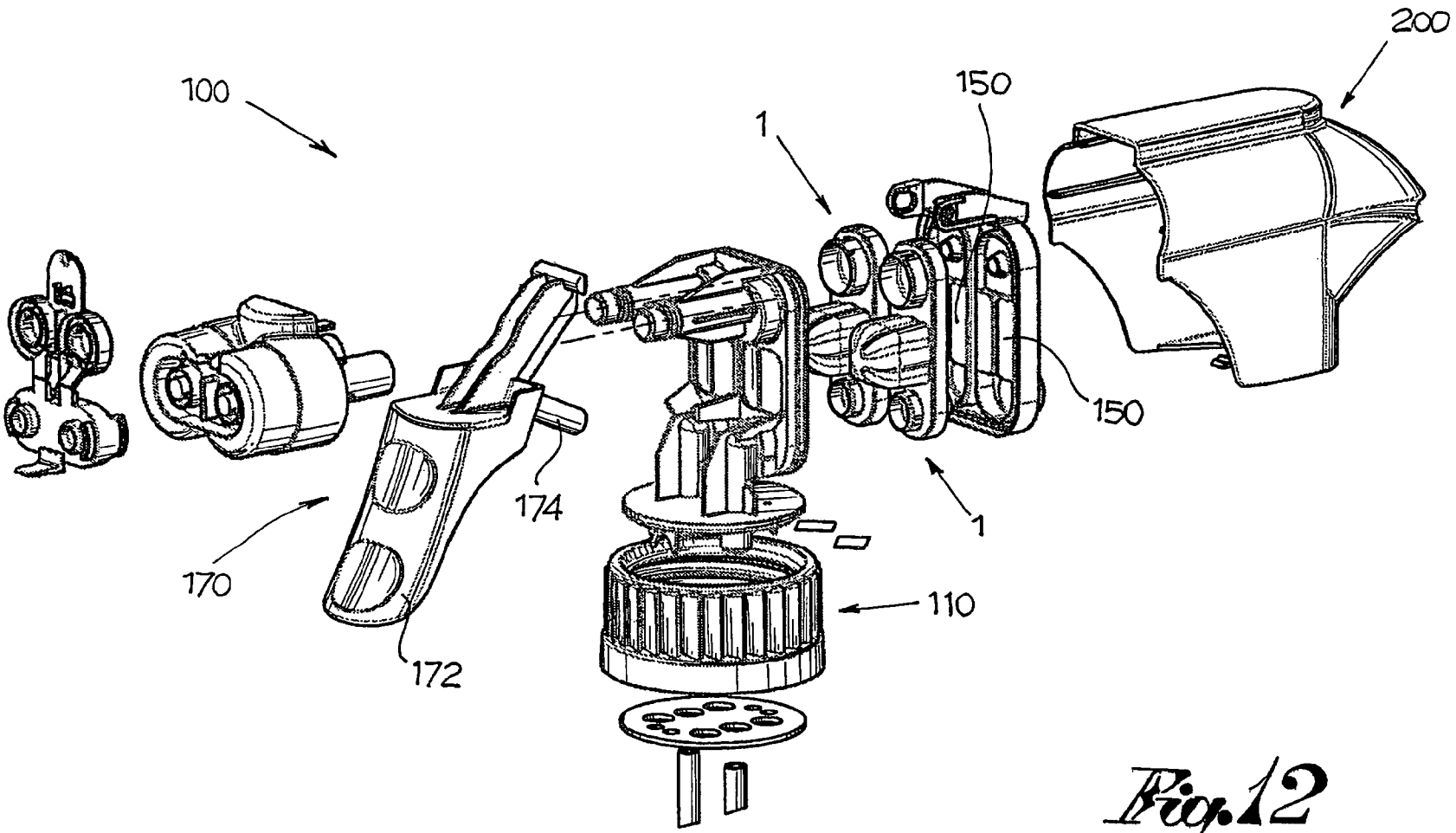
FIG. 12 shows a three-dimensional exploded view of a fluid dispensing device, in accordance with a further embodiment variation, comprising the pumping element of FIG. 9.
Figure 13:
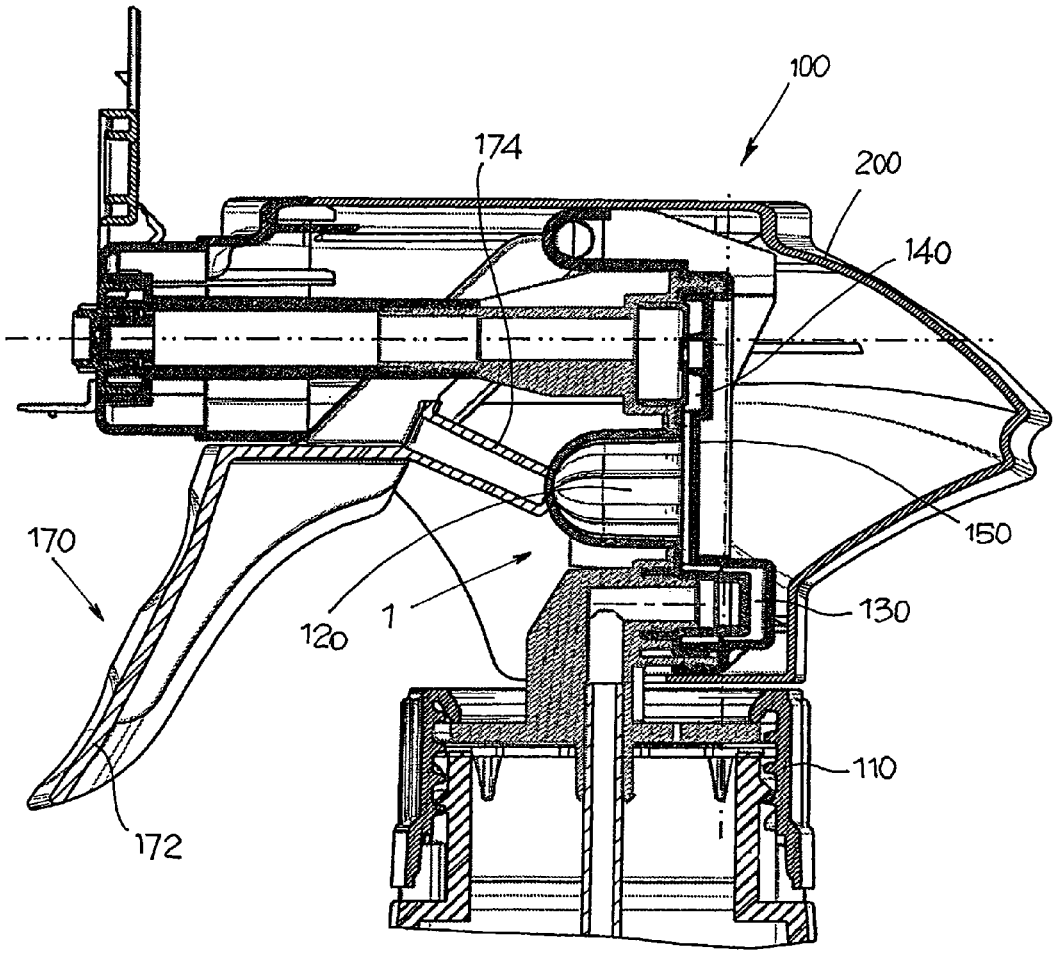
FIG. 13 shows a side section view of the device of FIG. 12 with assembled parts.
Figure 15:
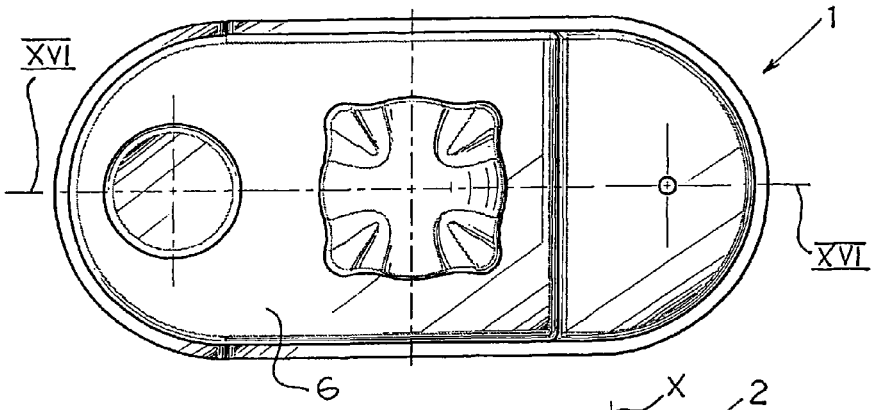
FIG. 15 shows a plan view of the pumping element of FIG. 14.
Figure 16:
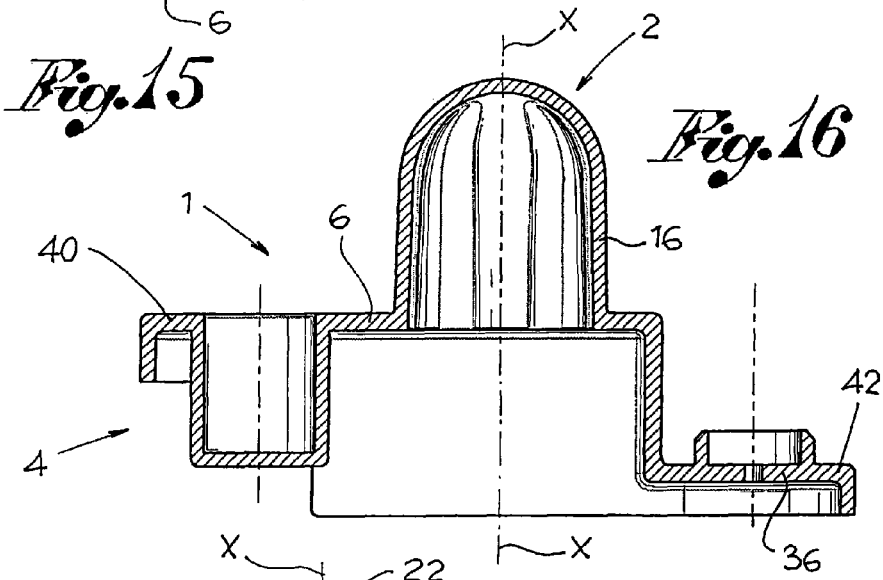
FIG. 16 shows a view of the pumping element of FIG. 14, sectioned according to line XVI-XVI of FIG. 15.

According to a preferred embodiment, said intake valve means comprise a cup element 30 protruding from base 4 (FIG. 11).

Said cup element 30 comprises a side cylindrical wall 32 and a bottom 34 at least partly separated from said side wall through a cut.

Moreover, said base 4 comprises a flexible portion 36 provided with a hole 38.

Said flexible portion 36, cooperating with said delimiting means, produces fluid ejection valve means suitable for allowing the fluid ejection during said ejection step and for preventing the fluid backflow from the ejection duct towards the pumping chamber during said intake step.

Figure 14:
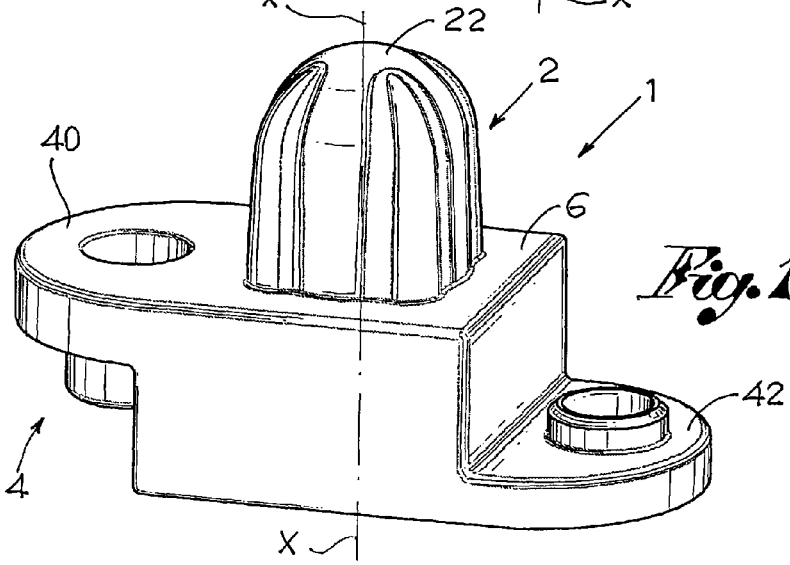
FIG. 14 shows a three-dimensional view of the pumping device according to a further embodiment variation.
Figure 17:
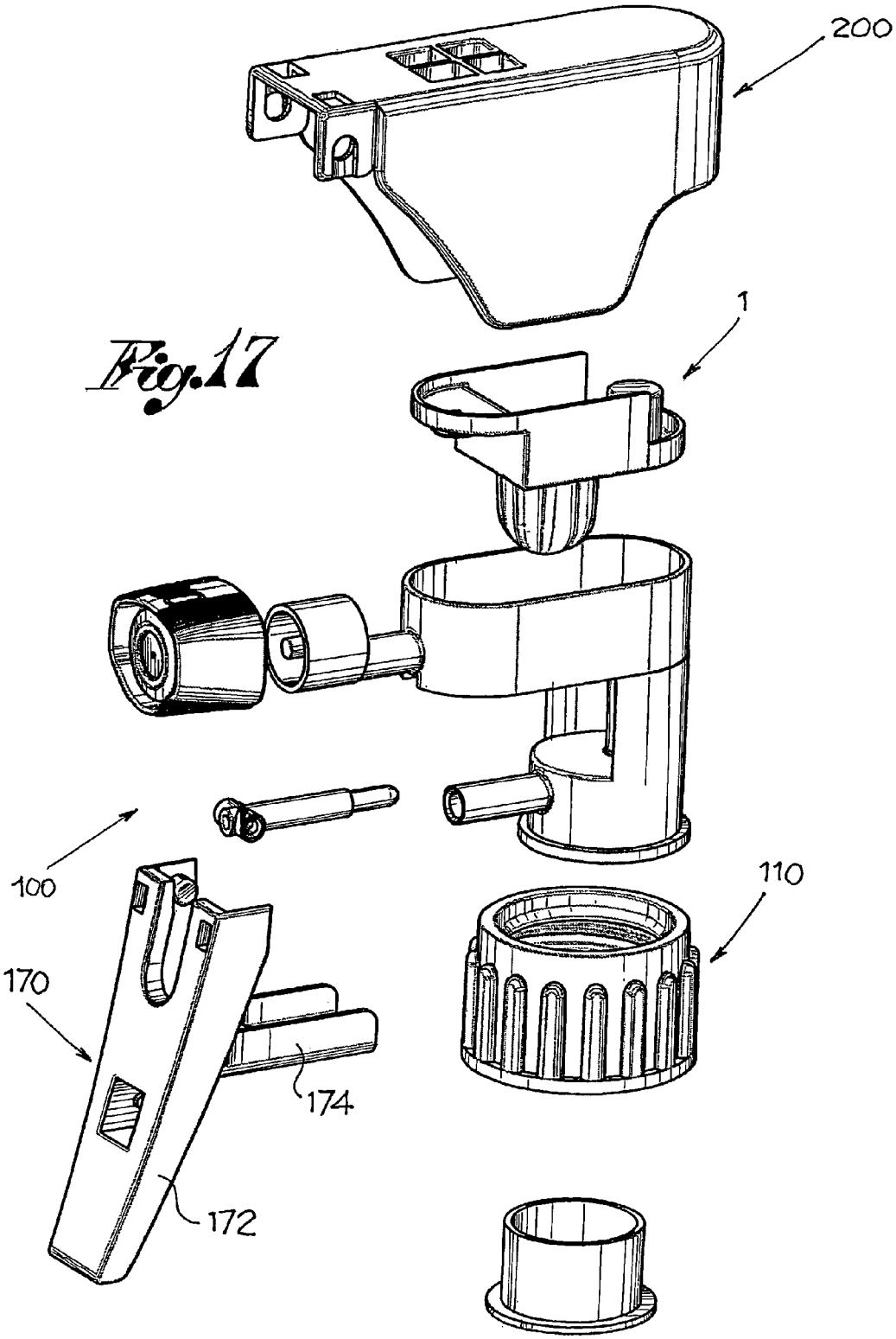
FIG. 17 shows a three-dimensional exploded view of a fluid dispensing device, in accordance with a further embodiment variation, comprising the pumping element of FIG. 14.

According to an even further embodiment, said base 4 exhibits a shelf structure (FIG. 14).

In other words, said base 4 comprises a first shelf 40, from which said membrane 2 protrudes, and a second shelf 42. Said first shelf and said second shelf define parallel but not coinciding planes.

Preferably, at said first shelf 40 there are obtained said intake valve means.

According to a further embodiment, said second shelf 42 comprises said flexible portion 36 which, cooperating with said delimiting means, produces said fluid ejection valve means.

According to a preferred embodiment, said pumping element 1 is made of thermoplastic material. Preferably, said pumping element is made of Elvax® 560, a resin marketed by Du Pont.

Moreover, according to a preferred embodiment, the fluid dispensing device 100 comprises covering means suitable for seating said pumping means and said delimiting means for forming a single enclosure and/or for hiding them.

According to a preferred embodiment, said covering means comprise an enclosure 200.

Said covering means are suitable for being associated to said connecting means and/or said actuating means.

In the standard operation, the fluid dispensing device 100 is associated to the container of the fluid or fluids.

In a first configuration of the device, said dispensing configuration, the membrane is in the non-deformed configuration and the fluid to be dispensed is contained in the pumping chamber 120.

By handling said actuating means, the trigger or the button influence the membrane, thus deforming it. The volume reduction of the pumping chamber pushes the fluid contained therein outside said pumping chamber.

The intake valve means close the intake duct whereas the ejection valve means keep the ejection duct open.

The fluid flows through said ejection duct and is dispensed outside of the device.

Once the actuating means have been released, membrane 2 passes from the deformed configuration to the non-deformed configuration, elastically, by virtue of the material it is made of.

While the membrane passes from the deformed configuration to the non-deformed configuration, the increase of volume of the pumping chamber produces an under-pressure.

The intake valve means keep the intake duct open, thus allowing another fluid to flow through said intake duct from the containment means to the pumping chamber.

The ejection valve means close the ejection duct, thus preventing the backflow of fluid already ejected through said ejection duct towards the pumping chamber.

At first, if the pumping chamber is still without fluid, some repeated actuations of the actuating means allow taking fluid into said chamber.

Innovatively, in the passage from the non-deformed configuration to the deformed configuration and vice versa, said membrane exhibits regular operation and high reliability following repeated and consecutive uses of the device.

In particular, the wavy structure described above allows calibrating the pliability or the stiffness of the membrane according to the needs, allowing quick return to the non-deformed configuration.

At the same time, the pumping element and in particular the membrane, exhibit considerable reliability. In other words, they are not subject to breakage even following repeated, sudden and consecutive fluid dispensing.

Advantageously, moreover, the manufacture of a pumping element comprising an elastic membrane is inexpensive as compared to the manufacture of a system with cylinder, piston and return spring.

Moreover, said pumping element exhibits the advantage that it can be made chemically compatible with the fluids it contacts by simply changing the material used.

According to an even further advantageous aspect, said pumping element may be provided with a pumping chamber having a desired volume by simply changing the thickness of the annular wall.

It is clear that a man skilled in the art can make several changes and adjustments to the device described above in order to meet specific and incidental needs, all falling within the scope of protection defined in the following claims.

The invention claimed is:

1. A device for dispensing at least one fluid, associable to containment means suitable for containing said at least one fluid, wherein said device comprises:

pumping means in fluid connection with said containment means, said pumping means being suitable for sucking said fluid from said containment means and for ejecting said fluid from said device, wherein said pumping means comprise at least one elastic deformable membrane having a membrane axis and defining a pumping chamber, said pumping chamber being suitable for passing from a maximum volume in a non-deformed configuration of the membrane to a reduced volume in a deformed configuration of said membrane;

actuating means, suitable for being handled by an operator for deforming said membrane and dispensing said fluid;

wherein said membrane comprises an active portion designed to be influenced by said actuating means;

wherein the active portion of the membrane comprises a wavy annular wall which develops circumferentially about said axis for producing a desired stiffness or pliability of said membrane, wherein the annular wall exhibits a succession of concave and convex portions relative to the membrane axis; and wherein said membrane comprises a dome portion which closes said membrane at the top.

2. A device according to claim 1, wherein said annular wall exhibits a plurality of sides, wherein each side comprises at least one concave portion relative to said membrane axis.

3. A device according to claim 2, wherein said concave portion is jointed to convex portions.

4. A device according to claim 3, wherein said sides are jointed to one another by arched portions.

5. A device according to claim 1, wherein the thickness of said annular wall is substantially constant along the circumferential development about said membrane axis.

6. A device according to claim 1, wherein said dome portion is externally smooth.

7. A device according to claim 1, wherein said membrane is associated to positioning means suitable for positioning said membrane into said device.

8. A device according to claim 7, wherein said positioning means comprise a base comprising intake valve means.

9. A device according to claim 8, wherein said positioning means comprise a base comprising ejection valve means.

10. Device according to claim 1, wherein said actuating devices comprise a trigger.

11. A device according to claim 1, further comprising connecting means suitable for connecting said device to said containment means.

12. A device according to claim 1, further comprising covering means suitable for housing said pumping means.

13. A device according to claim 1, wherein said membrane is made of thermoplastic resin.

14. A pumping element suitable for being associated to a device for dispensing a fluid, wherein said device comprises delimiting means suitable for cooperating with said pumping element for producing a pumping chamber, an intake duct and an ejection duct of the fluid, wherein said pumping element comprises:

a base suitable for being connected to said delimiting means for forming said intake duct and said ejection duct;

an elastic deformable membrane suitable for connecting to said delimiting means for forming a pumping chamber, said membrane having a membrane axis;

wherein the membrane comprises a wavy annular wall which develops circumferentially about said axis for producing a desired stiffness or pliability of said membrane, and wherein said annular wall exhibits a succession of concave and convex portions relative to the membrane axis; and wherein said membrane comprises a dome portion which closes said membrane at the top.

15. A pumping element according to claim 14, wherein said annular wall exhibits a plurality of sides, wherein each side comprises at least one concave portion relative to said membrane axis.

16. A pumping element according to claim 15, wherein said concave portion is jointed to convex portions.

17. A pumping element according to claim 16, wherein said sides are jointed to one another by arched portions.

18. A pumping element according to claim 14, wherein the thickness of said annular wall is substantially constant along the circumferential development about said membrane axis.

19. A pumping element according to claim 14, wherein said dome portion is externally smooth.

20. A pumping element according to claim 14, wherein said base comprises intake valve means.

21. A pumping element according to claim 14, wherein said base comprises a flexible portion which, in cooperation with said delimiting means, forms ejection valve means.

22. A pumping element according to claim 14, wherein the wall is free from edges at the joining between a convex portion and the subsequent concave one.

23. A device according to claim 1, wherein the wall is free from edges at the joining between a convex portion and the subsequent concave one.

24. A device according to claim 1, wherein said annular wall is delimited by an internal edge and by an external edge, wherein said internal and external edges exhibit a wavy annular pattern of the annular wall and produce a closed line about said membrane axis consisting of a succession of arched portions.

25. A pumping element according to claim 14, wherein said annular wall is delimited by an internal edge and by an external edge, wherein said internal and external edges exhibit a wavy annular pattern of the annular wall and produce a closed line about said membrane axis consisting of a succession of arched portions.

* * * * *

UNITED STATES PATENT AND TRADEMARK OFFICE

CERTIFICATE OF CORRECTION

PATENT NO. : 7,810,678 B2
APPLICATION NO. : 11/667500
DATED : October 12, 2010
INVENTOR(S) : Riccardo Alluigi It is certified that error appears in the above-identified patent and that said Letters Patent is hereby corrected as shown below:

Title page item 75
CITY OF INVENTOR:

"Acqui Therme (IT)" should read --Acqui Terme (IT)--.

Title page item 57
ABSTRACT:

"A device for dispensing at least one fluid comprises pumping means comprising an elastic deformable membrane (2) having a wavy annular wall (16) for producing a desired stiffness or pliability for said membrane (2). A pumping element (1) comprises a base (4) and said elastic deformable membrane (2)."

should read

--Many fluid pumps use a deformable dome to transition between being fully expanded to almost fully compressed and back again to dispense the desired fluid. As a rule, these domes are made of an elastic deformable membrane of a uniform thickness that, after compression, its resiliency is supposed to expand the chamber back to its original size and shape. This common design creates problems because the domes can break and also lock themselves open or shut. It has been found that if the dome has both thicker and thinner sections forming a wavy annular wall, compression is facilitated by the thinner sections, and the thicker sections provide extra resiliency to facilitate the expansion of the chamber after dispensation, resulting in a better overall reliability and performance of the fluid pump.--.

Signed and Sealed this
Fifth Day of April, 2011

David J. Kappos

David J. Kappos
*Director of the United States Patent and Trademark Office*